US007076924B2

(12) United States Patent
Thompson

(10) Patent No.: US 7,076,924 B2
(45) Date of Patent: Jul. 18, 2006

(54) OVALIZED CONCRETE BLOCK-OUT TUBE WITH TEAR AWAY NAILING FLANGE

(76) Inventor: Harry A. Thompson, 2009 Redwood Ave., Wyomissing, PA (US) 19610

( * ) Notice: Subject to any disclaimer, the term of this patent is extended or adjusted under 35 U.S.C. 154(b) by 483 days.

(21) Appl. No.: 10/648,617

(22) Filed: Aug. 26, 2003

(65) Prior Publication Data

US 2005/0044809 A1 Mar. 3, 2005

(51) Int. Cl.
*E04B 1/41* (2006.01)
*E04B 1/61* (2006.01)

(52) U.S. Cl. ..... 52/100; 52/295; 52/699; 52/704; 52/705; 405/259.5; 405/259.6

(58) Field of Classification Search ..... 52/100, 52/295, 432, 378, 376, 367, 513, 699, 704, 52/705; 405/259.5, 259.6; 411/82
See application file for complete search history.

(56) References Cited

U.S. PATENT DOCUMENTS 3,500,607 A * 3/1970 Wilson ..... 52/699
3,867,804 A * 2/1975 Wilson ..... 52/699
4,302,131 A * 11/1981 Brown ..... 405/259.5
4,430,025 A * 2/1984 Ciavatta ..... 405/259.6
4,620,406 A * 11/1986 Hugel et al. ..... 52/704
4,968,185 A * 11/1990 Leibhard et al. ..... 405/259.5
5,134,828 A 8/1992 Baur
5,282,697 A * 2/1994 Maechtle ..... 405/259.6
5,386,675 A 2/1995 Baur et al.
5,528,867 A 6/1996 Thompson
RE35,659 E * 11/1997 Ernst et al. ..... 411/82
5,934,821 A * 8/1999 Shaw et al. ..... 404/62

* cited by examiner

*Primary Examiner*—Robert Canfield
(74) *Attorney, Agent, or Firm*—Sanford J. Piltch, Esq.

(57) ABSTRACT

A block-out tube for use in joining together pre-cast concrete members, the block-out tube having an ovalized cross-section, an integral elongate imperforate hollow tubular body with smoothly curved corrugated walls, a rounded tip closing the bottom end thereof, a mounting flange with tear-away nail tabs at the top open end thereof, and a removable transparent member for sealing the top end for preventing water and debris from entering the interior of the tube. The block-out tube, secured by attaching the tear-away tabs to a concrete pouring form, is cast into the top of the lower concrete member, the ovalized corrugated body being embedded therein and the top sealed end being exposed at the top surface thereof, after the removal of the form. When the concrete members are erected and joined, the transparent sealing means at the top end is removed, the block-out tube is filled with grout, and a structural rod extending outwardly from one member is fitted into the grout-filled tube as the one member is joined to the other member, the grout engaging the structural rod and the corrugated tube wall, forming a strong joint between the two concrete members.

20 Claims, 5 Drawing Sheets

OVALIZED CONCRETE BLOCK-OUT TUBE WITH TEAR AWAY NAILING FLANGE

BACKGROUND OF THE INVENTION

The present invention relates generally to connection devices for joining together pre-cast concrete members such as panels or columns stacked one on top of the other to form building walls, the connection devices employing a grouted connection between a block-out tube cast into the top of a lower concrete member and a structural rod cast into the bottom of an upper concrete member. More particularly, the present invention relates to an ovalized block-out tube that provides structural strength, in addition to a tolerance for misalignment with the structural rod, when the upper panel is assembled onto the lower panel.

Conventional connections for joining cast concrete wall panels use metal spiral tube sections cast into the top of the lower panel. These block-out tube sections are mounted on a framing member in the form used to cast the panel, oriented inwardly in the center of the top wall of the panel. Tape is used to close the bottom of the spiral tube sections. After pouring of the concrete panel and setting of the concrete, the forms are removed and the open ends of the tubes are sealed or taped, or alternatively a plug is driven into each tube.

A lower panel with conventional spiral tubes cast in place is erected and the tubes are opened and filled with grout or mortar. An upper panel with structural rods aligned with the tubes and extending downwardly from the lower surface of the panel is lowered onto shims with the rods extending into the grout placed in the opened tubes. The grout sets to form a joint between the two panels.

It is difficult to secure the spiral tube used in the conventional joint to the forms used for pouring a lower panel. The taped seal at the inner end of the tube may leak allowing concrete to flow into the interior of the tube during the casting of the lower panel. The tape and plug seals used to close the tube sections are ineffective and frequently allow water, moisture, and dirt to collect in the tubes prior to the erection of the panels. If the water in the tube freezes there is a risk that resultant expansion will crack and ruin the panel. Any debris collected within the tube will degrade the quality of the connection formed by the mortar when the panels are erected. The sharp corner in the concrete at the bottom of the tube concentrates stress in the cast panel and can lead to cracking of the panel.

In addition, the circular cross-section of the spiral tubes is not much larger in diameter than the structural rods which are mortared therein, and thus do not allow any appreciable tolerance for misalignment of the respective connection devices of the two panels. Often concrete panels are joined by multiple sets of tubes, spaced along the length of top surface of the lower panel, and rods, spaced along the bottom surface of the upper panel. If there is slight variation in the spacing of the tubes as compared with the spacing of the rods, assembly of the two panels becomes very difficult if not impossible.

An improvement to the conventional connection apparatus is disclosed in U.S. Pat. No. 5,134,828 [Baur] that discloses a closed-end blow molded tube for use as the block-out in a pre-cast lower panel. While this device overcomes some of the problems existing in the conventional connection device as described previously, it leaves some disadvantages unaddressed and further introduces new disadvantages. This device nicely solves the problem of keeping water, moisture, and debris from entering the block-out tube before, during, and after pouring of the concrete panel. However, this device is nominally circular in cross-section and straight-sided along its length, and therefore includes a series of recesses to engage the surrounding concrete and the internal grout. Engagement of the tube recesses with the concrete and the grout gives the device the structural strength important for joining the lower panel to an upper panel, but also creates areas of stress concentration in the pre-cast concrete panel that may increase the tendency of the concrete panel to crack. Additionally, the circular cross-section is the same as that used in the conventional spiral tube and therefore does not provide for any additional tolerance for misalignment of tubes and rods along the length of the two mating concrete panels. As a further minor inconvenience, this device is nailed to the concrete pouring forms and when the forms are removed, the nails are left sticking outwardly from the concrete panel with the nail heads trapped between the tube mounting flange and the concrete.

Accordingly, it is an object of the present invention to provide a block-out tube for use in joining pre-cast vertical concrete panels that provides structural strength without introducing stress concentrations into the poured concrete or grout. It is another object of the present invention to provide a block-out tube that prevents the entry of water, moisture, or debris that could degrade the quality of the grout connection inside the tube.

It is yet another object of the present invention to provide a block-out tube which may be separated from the concrete pouring form without leaving exposed nails protruding from the finished concrete panel. It is a further object of the present invention to provide a block-out tube which accommodates for minor misalignments of spacing and positioning between the tubes along the length of the lower concrete panel into which the tubes are cast and the structural rods along the length of the mating upper concrete panel into which the rods are cast.

Other objects will appear hereinafter.

SUMMARY OF THE INVENTION

The present invention overcomes the disadvantages inherent in the types of devices known in the prior art for joining vertical pre-cast concrete panels. While the disclosure herein refers to joining of pre-cast concrete panels, it is understood that the present invention may be used to join columns and other types of pre-cast concrete members.

The present invention comprises a tube of ovalized cross-section, which is non-cylindrical, and an elongate body corrugated with a series of periodic undulations. This tube is molded as an imperforate monolithic piece and is smooth along its length, with no sharp corners or edges. The tube includes a rounded tip at one end and a flange with tear-away tabs extended outwardly around the perimeter of the opposite open end. The open end of the tube is covered over with a waterproof transparent sheet, adhered to or molded onto the flange.

The tube of the present invention is intended to be cast vertically into the top side of a lower concrete panel with the covered flanged end facing upwardly and the elongate body with the rounded tip embedded in the panel. Once the concrete has set, the ovalized (or non-cylindrical) cross-section of the tube keeps it secure from rotating in the concrete panel and the corrugations along the length of the tube give it high pullout strength. Because of the gentle corrugations formed by the large radius undulations in the walls of the tube, as well as the rounded tube tip, no significant stress concentrations are introduced into the concrete panel by the presence of the tube.

For joining the lower concrete panel to an upper concrete panel having structural rods extending downwardly from the lower side thereof, the tubes are filled with grout or mortar and the upper panel is lowered onto the lower panel with the structural rods becoming embedded in the grout within the internal cavities of the tubes. The ovalized shape and corrugated walls of the tube provide structural strength to prevent the grout from rotating or pulling out from within the tube, as the grout engages the roughened surface of the structural rod to form a strong connection between the lower panel and the upper panel.

The transparent cover sheet over the open flanged end of the tube serves to prevent water or dirt from entering the tube during the molding of the concrete panel and during the interval between the molding and the erection of the panel when the panel may be stored onsite or in a warehouse for a considerable period of time. The transparency of the cover sheet permits visual inspection of the interior of the tube prior to erection and joining of the concrete panels to ensure that water, moisture, and debris have not entered or accumulated in the tube. At the time of erection, the cover sheet may be either removed or punctured and bent away in order to allow the filling of the tube with grout and the insertion of the structural rod. In the unlikely event that a small amount of water should seep into the interior of the tube and freeze, the curved walls and rounded tip lift the ice as it freezes, regardless of the orientation of the panel at the time, thus reducing the risk of stress cracking in the concrete.

Prior to the forming of the concrete panel, a number of tubes will be attached at appropriate locations to a member at the top of the panel form by nailing or fastening through the tear-away tabs on the tube flange into the form member. When the panel is poured, the concrete will encase the elongate portion of the tube with the tube flange being flush along the top side of the panel. After the concrete has set, the form may be separated from the tube by breaking the tear-away tabs off from the tube flange, leaving the embedded tube with the covered flanged end facing outwardly from the panel. The tabs and nails can then later be removed from the form member if desired.

The major axis of the ovalized (or non-cylindrical) cross-section of the tube, which is about fifty percent longer than either the minor axis or the diameter of the conventional or improved block-out tubes previously discussed, is oriented along the length of the concrete panel. Therefore, when two panels are joined as described previously, the tube of the present invention is capable of accommodating a greater amount of misalignment between the tubes and the corresponding structural rods than can be accommodating in prior art devices.

BRIEF DESCRIPTION OF THE DRAWINGS

For the purpose of illustrating the invention, there is shown in the drawings forms which are presently preferred; it being understood, however, that the invention is not limited to the precise arrangements and instrumentalities shown.

DETAILED DESCRIPTION OF THE PREFERRED EMBODIMENTS

The following detailed description is of the best presently contemplated mode of carrying out the invention. The description is not intended in a limiting sense, and is made solely for the purpose of illustrating the general principles of the invention. The various features and advantages of the present invention may be more readily understood with reference to the following detailed description taken in conjunction with the accompanying drawings.

Figure 1:
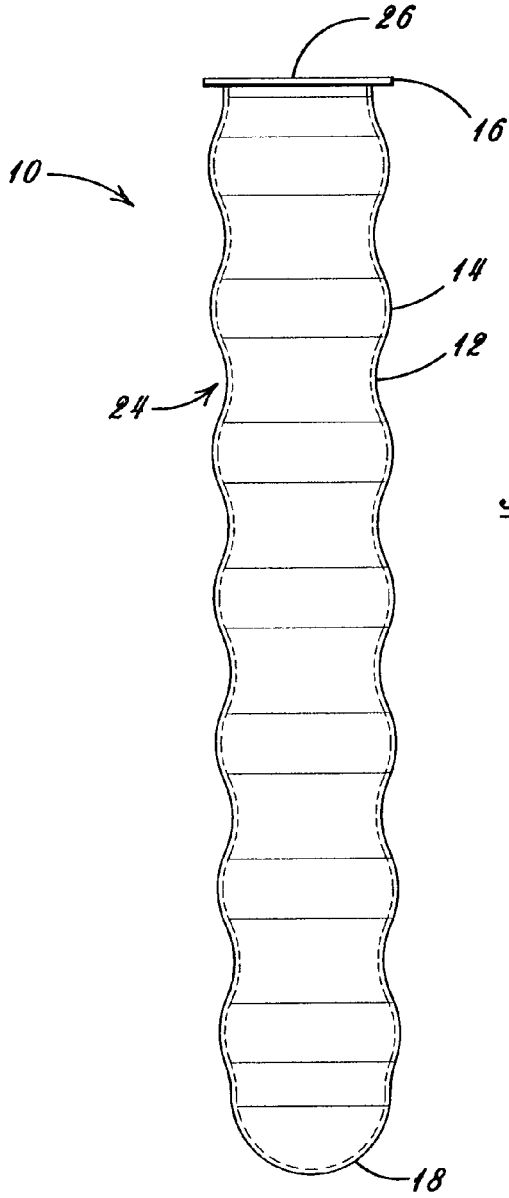
FIG. 1 is a side view of the ovalized concrete block-out tube of the present invention.

Referring now to the drawings in detail, where like numerals refer to like parts or elements, there is shown in FIG. 1 a side view of the ovalized (or non-cylindrical) block-out tube 10. The tube 10 is comprised of a rigid corrugated ovalized elongate tubular wall 24 including a series of large-radius circumferential protrusions 14 and large-radius circumferential indentations 12 along the axial orientation thereof. The tube 10 further comprises a closed rounded tip 18 at one end thereof and an open end 26 at the opposite end thereof. The open end 26 includes an integral nail flange 16 with tear-away tabs 22, as shown in the top view of FIG. 2. The tube 10 is preferably blow molded from thermoplastic resin to a relatively uniform thickness to give the wall 24 consistent strength along its length. The blow molded tube 10 is imperforate and waterproof, with the tube wall 24, the tube tip 18, and the flange 16 formed from one integral piece of blow molded material.

Figure 3:
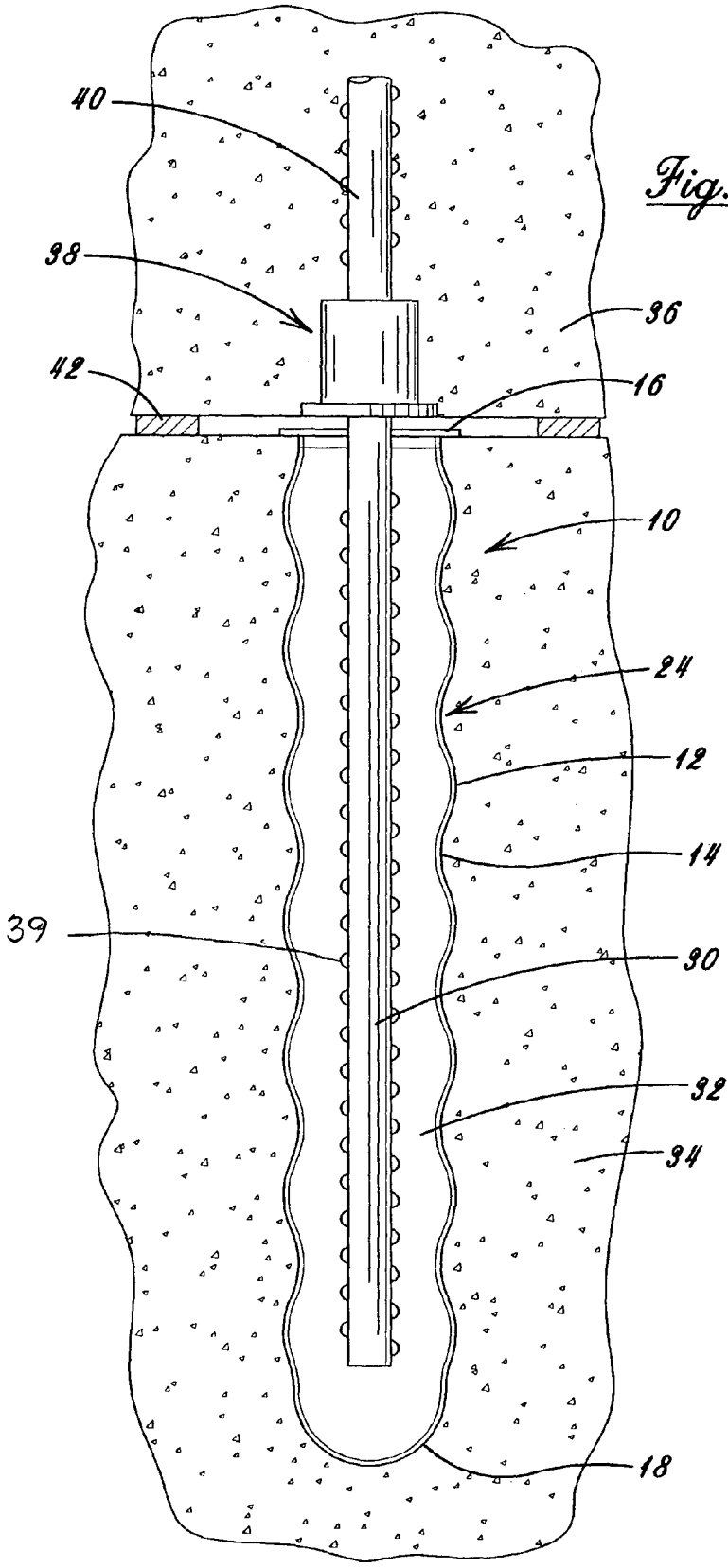
FIG. 3 is a partially broken away side view of the ovalized block-out tube of the present invention showing the connection of two concrete forms with a structural rod centered within the tube.

As shown in FIG. 3, the tube 10 is designed to be used in conjunction with a structural rod assembly 38 to align and secure an upper concrete panel 36 to a lower concrete panel 34 during assembly of concrete panels into a larger structure. Multiple sets of tubes 10 and rod assemblies 38 may be used to secure each pair of concrete panels 34, 36. The ovalized or non-cylindrical block-out tube 10 is embedded in the concrete at the top of the lower panel 34 at the time of casting, and the upper rod portion 40 of the rod assembly 38 is embedded in the concrete at the bottom of the upper panel 36 at the time of casting with the lower rod portion 30 extended outwardly therefrom. The concrete of the lower panel 34 engages the corrugations 12, 14 on the outside of the wall 24 of the tube 10 to secure the tube 10 in the panel 34 with a significantly higher pullout strength than would occur without the corrugations 12, 14. The large radii of the corrugations 12, 14, as well as the rounded tube tip 18, minimize the stress concentrations on the concrete panel 34 to guard against cracking. Additionally, the ovalized cross-section of the tube 10 prevents the tube 10 from turning within the concrete panel 34 without the need for circumferential recesses for concrete engagement, as may be required in block-out tube devices of generally circular cross-section.

Upon assembly of panels 34, 36, the interior of the tube 10 is filled with the grout 32 and the lower rod portion 30 of the rod assembly 38 is inserted into the grout-filled tube 10. The grout 32 engages the corrugations 12, 14 on the inside of the wall 24 of the tube 10, and additionally engages the roughened surface 39 (shown as outward facing "dimples" arrayed along the outer surface of the rod 38) along the surface of the lower rod portion 30, to form a strong connection between the two panels 34, 36. As in the case of the concrete, the large radii of the corrugations 12, 14, as well as the rounded tube tip 18, minimize the stress concentrations on the grout 32 to guard against cracking. Further, the ovalized cross-section of the tube 10 prevents the grout 32 from turning within the tube 10 without the need for circumferential recesses for grout engagement, as may be required in block-out tube devices of generally circular cross-section.

Figure 2:
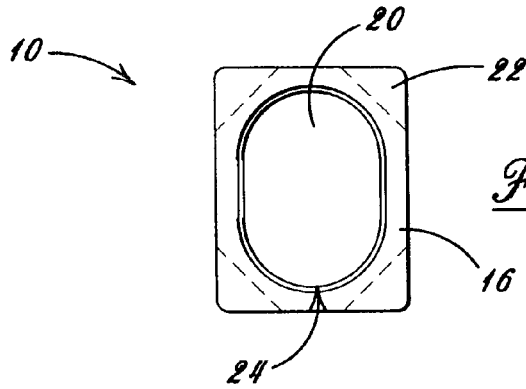
FIG. 2 is a top plan view of the ovalized concrete block-out tube of the present invention showing the tear-away nail flanges.

The integral flange 16 extends outwardly from the tube 10 at the open end 26, the flange 16 extending completely around perimeter of the end 26. As shown in FIG. 2, the nail flange 16 includes tear-away nail tabs 22 at the corners thereof for removably fastening the tube 10 to a concrete pouring form. The open end 26 may be sealed closed by a transparent plastic cover sheet 20 which may be adhered to the upper surface of the flange 16 using an appropriate adhesive (not illustrated). The adhesive forms a waterproof seal between the cover sheet 20 and the flange 16 thereby closing off the interior of the tube 10 against moisture, water, and dirt. The cover sheet 20 is adhered to the flange 16 during manufacture of the tube 10, prior to embedding the tube 10 into the lower panel 34. Alternatively, the open end 26 may be sealed closed by a plastic sheet blow molded integrally with the tube 10. Other types of seals may also be used. The transparency of the cover sheet 20 enables a worker, prior to assembly of the concrete panels 34, 36, to visually inspect the interior of the tube 10 to ensure that it is clean and without contaminants.

In one embodiment, the tube 10 has a length of about 24 inches, an ovalized (or non-cylindrical) cross-section with a minor axis of about 3½ inches and a major axis of about 5 inches, and is located midway between the sides of a concrete panel having a thickness of about 12 to 18 inches, with the minor axis oriented in parallel with the panel thickness. The radius of curvature of the corrugations 12, 14 is about 6 inches so that the peak to trough height of the undulations of the tube wall 24 is about ½ inch. The tube 10 may be molded from a high density polyethylene or other suitable plastic resin and may have a wall thickness of about 0.080 to 0.100 inch. A waterproof adhesive seals the transparent cover sheet 20 to the upper surface of the flange 16 but not to the tear-away tabs 22.

The lower panel 34 is cast conventionally, on its side, using appropriately sized wooden or metal forms, and concrete and reinforcing bars. When the forms are readied for pouring, a number of the ovalized concrete block-out tubes 10 are fastened to the form member defining the top wall of the panel, each tube 10 being fastened using finishing nails or other fasteners driven through the tear-away tabs 22 of the nailing flange 16 in order to removably hold the tube 10 in place on the side of the form. The tube 10 extends into the form and is preferably located midway between the top and the bottom of the form.

After the appropriate number of ovalized tubes 10 have been nailed to the form, reinforcing bars are placed in the form and concrete is flowed into the form. The concrete surrounds the tube 10 and envelopes the corrugations 12, 14 in the outer surface of the tube wall 24. The imperforate construction of the tube wall 24, the tube tip 18, and the cover sheet 20 prevent the concrete from entering the interior of the hollow tube 10. Further, the corrugations 12, 14 stiffen the tube wall 24 and prevent the pressure of the liquid concrete flowed into the mold from crushing the tube 10. This pressure, depending upon the depth of the tube 10 in the mold, may be as great as 450 pounds per square inch.

After the concrete in the form has set to make the panel, the top wall form is stripped away from the panel 34 by pulling off the tear-away tabs 22 from the flange 16, leaving the cover sheet 20 bonded to the flange 16 and exposed on the top wall of the panel 34. The upper panel 36 may be similarly formed with the upper rod portion 40 of the rod assembly 38 embedded in the panel 36 and the lower rod portion 30 extending outwardly from the bottom side of the upper panel 36 after the concrete pouring form is removed. Both cast panels may be stored at the manufacturing site or shipped to the job site as required.

Following the casting of the lower panel 34, the flanged ends 26 of the tubes 10 remain sealed by the cover sheets 20 to prevent water, moisture, or debris from entering the interior thereof. Preventing water from entering the tube 10 is particularly important because water collected in the tube 10, when frozen, expands and could crack and ruin the panel 34. Debris or moisture collected within the tube 10 could prevent the grout 32 from forming a proper joint with the tube 10. The cover sheet 20 is transparent to serve as a window to permit visual inspection of the interior of the tube 10 to ensure that it has remained empty and clean during the time interval between casting of the panel 34 and opening the cover sheet 20 to receive the grout 32 when the lower panel 34 is erected and joined to the upper panel 36.

At the time of erection with the lower panel 34 positioned vertically with the cast-in-place block-out tubes 10 facing upwardly and opening on the top wall of the lower panel 34, a worker first visually inspects the interior of the tubes 10, and finding the interiors to be clean and empty, the worker then removes the cover sheets 20. A cover sheet 20 may be removed physically by first puncturing the sheet 20 and then tearing the sheet 20 away from the flange 16. In a tube 10 sealed closed by an integral cover sheet 20, the cover sheet 20 may be burned off using a torch commonly used and available when erecting concrete structures. Alternatively, the cover sheet 20, whether integral or adhered to the flange 16, may be cut away, or in some circumstances, ruptured and bent down into the interior of the tube 10.

Opening the cover sheet 20 may injure the tube wall 24 cast in the concrete panel. Such injury is incidental to the operation of the tube 10 since once the cover sheet 20 is removed to open the interior of the tube 10 there is no longer a need to maintain a sealed interior. After the tube 10 is opened, the grout mixture 32 is poured into the open tube 10 and fills the interior thereof. The upper panel 36 is positioned vertically above the lower panel 34 with the lower rod portions 30 extending downwardly, with each lower rod portion 30 positioned above a block-out tube 10. Shim plates 42, which may be ½ inch thick plates measuring six inches on a side, are place on the upper surface of the lower panel 34 at appropriate locations. The upper panel 36 is carefully lowered down on top of the lower panel 34 so that each lower rod portion 30 extends down into a grout-filled tube 10 until the upper panel 36 rests in place on the shims 42 on the lower panel 34.

The grout 32 is then allowed to harden in order to form a strong, rigid connection between the two panels 34, 36. Grout extends into the corrugations 12, 14 on the interior of the walls 24 of the tubes 10 to form connections with the lower panel 34; the grout 32 also engages the roughened surface 39 of the lower rod portions 30 to form a strong connection with the rod assembly 38 and with the upper panel 36. Once the grout 32 is fully set, the resulting high strength concealed joints between the panels 34, 36 are completely confined within the thickness of the panels and do not project beyond the panel side walls. If desired, the horizontal space between the panels 34, 36 and the shims 42 may be caulked or pointed.

Figure 3A:
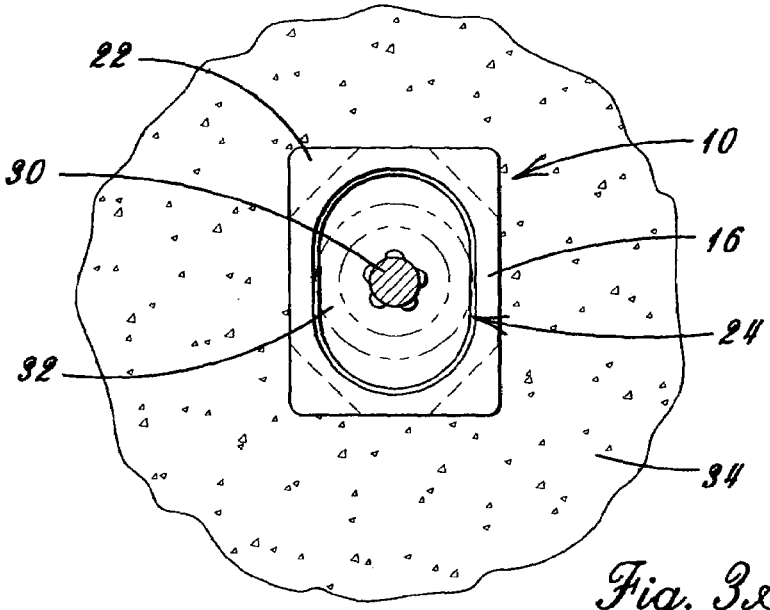
FIG. 3A is a top view of the ovalized block-out tube of the present invention showing the structural rod centered within the tube.
Figure 4A:
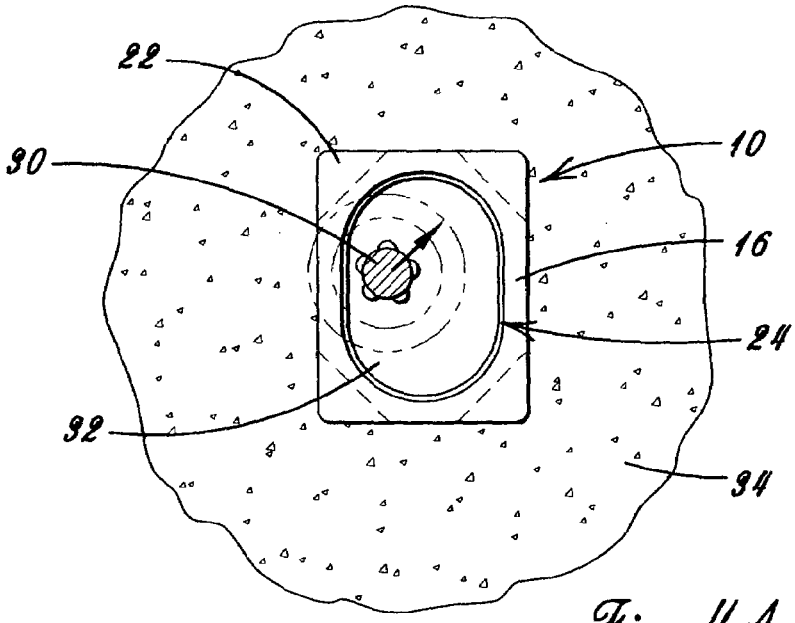
FIG. 4A is a top view of the of the ovalized block-out tube of the present invention showing the off-center structural rod within the tube.
Figure 4:
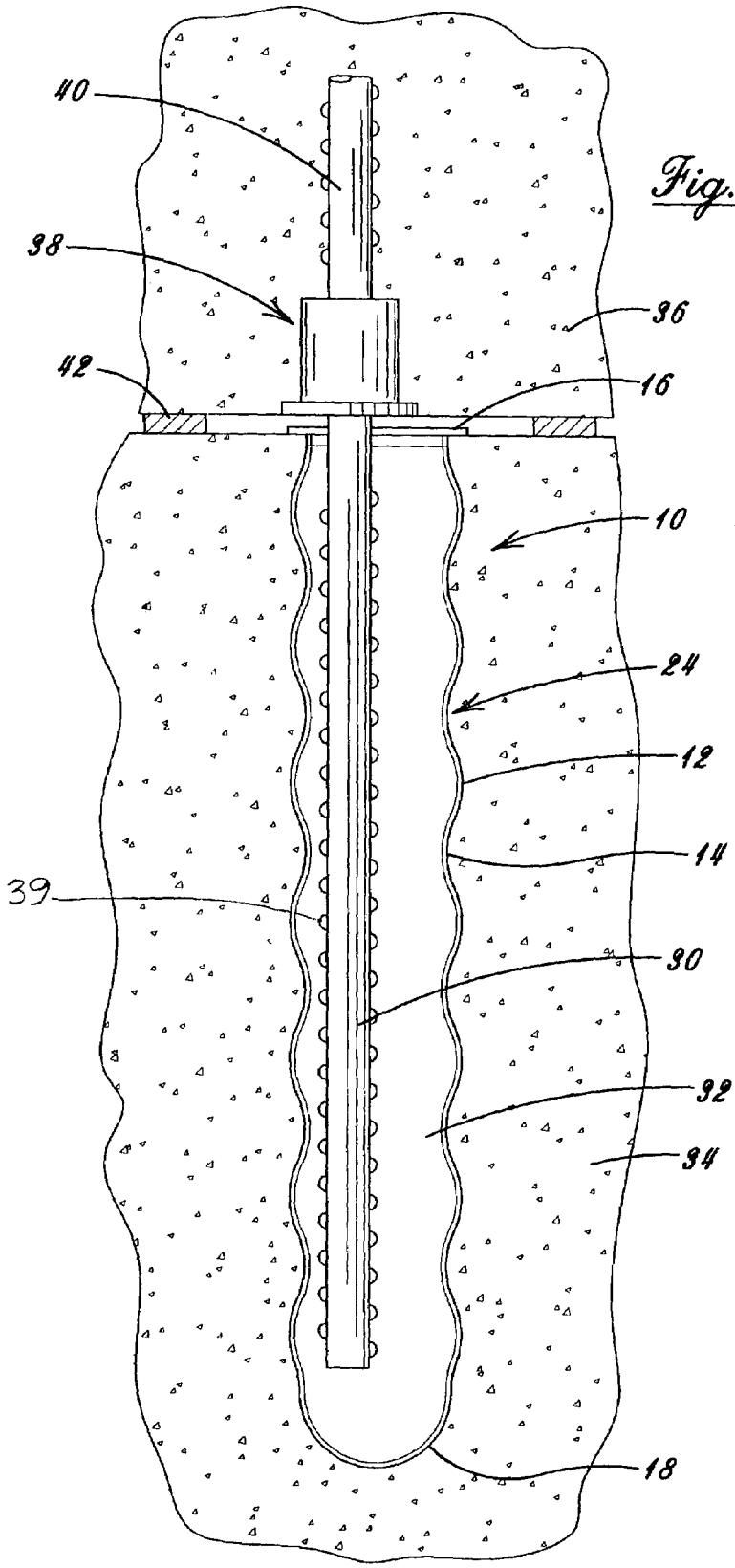
FIG. 4 is a partially broken away side view of the ovalized block-out tube of the present invention showing the connection of two concrete forms with an off-center structural rod within the tube.

During assembly of the upper panel 36 onto the lower panel 34, it is possible that some of the multiple pairs of rod assemblies 38 and block-out tubes 10 may not be perfectly aligned along the length of the panels 34, 36. Since the major axis of the ovalized tubes 10 is positioned parallel to the length of the panels 34, 36, the ovalized tube 10 of the present invention permits increased tolerance for such misalignments when compared with a block-out tube of generally circular cross-section. This clearance advantage is shown in FIGS. 4, 4A, which illustrate that the ovalized tube 10 can accommodate an off-center rod assembly 38 while retaining space for sufficient grout 32 to create a proper joint. When compared to FIGS. 3, 3A that show an axially centered lower rod section 30 within the non-cylindrical tube 10, it becomes readily apparent that the tube 10 is structured to accommodate the misalignment of the rod 38 not only principally along the length of the concrete form, i.e. the major axis of the ovalized tube 10, but also across the ovalized tube along the minor axis as shown in FIG. 4A.

Figure 5:
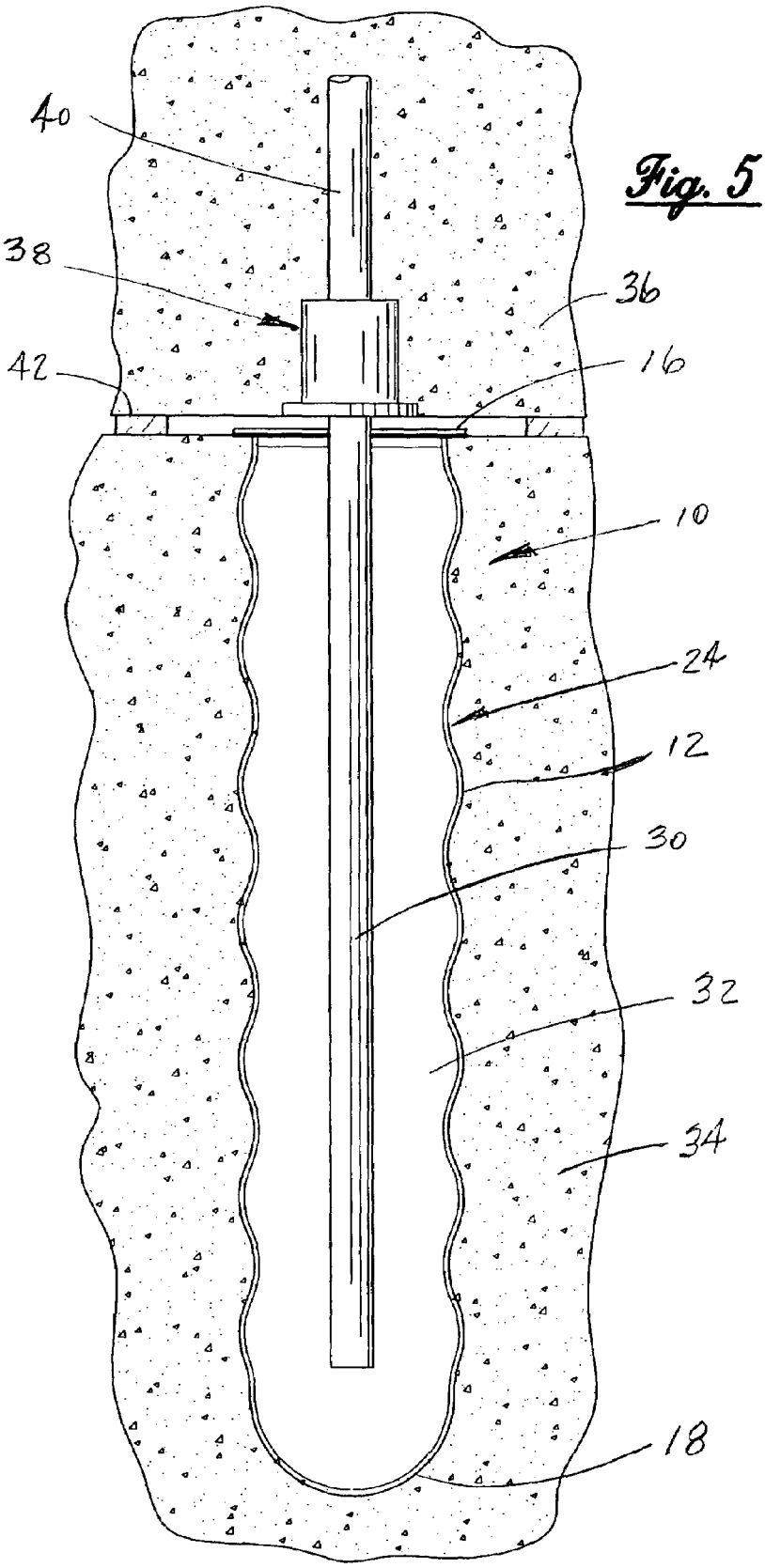
FIG. 5 is a partially broken away side view of the ovalized block-out tube of the present invention showing the connection of two concrete forms with a non-ribbed structural rod within the tube.

Referring to FIG. 5, there is shown a rod assembly 38 without the roughening of the outer surface, having relatively smooth sides. It is to be considered part of the present invention that the rod assembly 38 can have either a roughened outer surface 39, as shown in FIGS. 3, 3A, 4, 4A, or a relatively smooth outer surface, as shown in FIG. 5. In all other respects the depiction of the invention, its forming and assembly remain the same.

The present invention may be embodied in other specific forms without departing from the spirit or essential attributes thereof and, accordingly, the described embodiments are to be considered in all respects as being illustrative and not restrictive, with the scope of the invention being indicated by the appended claims, rather than the foregoing detailed description, as indicating the scope of the invention as well as all modifications which may fall within a range of equivalency which are also intended to be embraced therein.

The invention claimed is:

1. A tube member for use in a connection device joining pre-cast concrete panels or forms, said tube member comprising an integral elongate, imperforate, and hollow tubular body of a smoothly curved generally non-cylindrical cross-section having a first closed end and a second end, an outer wall including concrete-engaging circumferential corrugations propagating along the length of said body, an inner wall including grout-engaging circumferential corrugations propagating along the length of said body, form attachment means at said second end of said body for removably securing said body to a panel casting form; and a transparent seal member secured to said second end of said body, said seal member overlying and closing said second end of said body.

2. The tube member of claim 1 wherein said outer wall corrugations are smoothly rounded with a large radius curvature and said inner wall corrugations are smoothly rounded with a large radius curvature.

3. The tube member of claim 2, wherein the outside of said first closed end of said body is smoothly rounded and integrated with said smoothly rounded outer wall corrugations and the inside of said first closed end of said body is smoothly rounded and integrated with said smoothly rounded inner wall corrugations.

4. The tube member of claim 1, wherein said form attachment means comprises a circumferential flange integral with said body, said flange extending radially outwardly from said body at said second end.

5. The tube member of claim 4, wherein said circumferential flange includes a plurality of tear-away tabs for securing said tube member to the panel casting form, said tear-away tabs being capable of breaking off from said flange when the panel casting form is removed after the pre-cast concrete panel has set, leaving said body of said tube member embedded in the concrete panel with said flange of said second end flush with the side of the concrete panel.

6. The tube member of claim 1, wherein said transparent seal member comprises a waterproof transparent sheet and a waterproof joint securing said sheet to the top of said form attachment means.

7. The tube member of claim 1, wherein said body is formed from a seam-free plastic tube of generally ovalized cross-section, the wall of said body having circumferential corrugations propagating along the length thereof forming said concrete-engaging outer wall and said grout-engaging inner wall, said first end being seam-free, smoothly rounded, and integral with said wall, said form attachment means comprising an outwardly extending circumferential flange integral with said body, said seal member being secured to said flange.

8. The tube member of claim 7, wherein said seal is integral with said body.

9. The tube member of claim 7, wherein said flange includes a plurality of tear-away tabs for securing said tube member to the panel casting form, said tear-away tabs being capable of breaking off from said flange when the panel casting form is removed after the pre-cast concrete panel has set, leaving said body of said tube member embedded in the concrete panel with said flange of said second end flush with the side of the concrete panel.

10. The tube member of claim 1, wherein said body is molded from an integral mass of thermoplastic resin into a tube of generally ovalized cross-section, the wall of said body having circumferential corrugations propagating along the length thereof forming said concrete-engaging outer wall and said grout-engaging inner wall, said first end being smoothly rounded and integral with said wall, said form attachment means comprising an outwardly extending circumferential flange integral with said body, said seal member being secured to said flange.

11. The tube member of claim 10, wherein said seal is integral with said body.

12. The tube member of claim 10, wherein said flange includes a plurality of tear-away tabs for securing said tube member to the panel casting form, said tear-away tabs being capable of breaking off from said flange when the panel casting form is removed after the pre-cast concrete panel has set, leaving said body of said tube member embedded in the concrete panel with said flange of said second end flush with the side of the concrete panel.

13. A tube member for use in a connection device joining pre-cast concrete panels or forms, said tube member comprising an integral elongate, imperforate, and hollow tubular body of a smoothly curved generally non-cylindrical cross-section having opposite ends, a transparent wall sealed to one end of said body to overlie the interior of said body and close said one end, such wall, when ruptured or removed, permitting filling of the interior of said body with grout and insertion of a reinforcing bar into the grout within the interior of said body for forming a connection therewith, an outer wall including concrete-engaging circumferential corrugations propagating along the length of said body, an inner wall including grout-engaging circumferential corrugations propagating along the length of said body, and form-attachment means at said one closed end of said body for removably securing said body to a panel casting form.

14. The tube member of claim 13, wherein the other end of said body is closed, the outside of said other closed end being smoothly rounded and integrated with said outer wall corrugations and the inside of said other closed end being smoothly rounded and integrated with said inner wall corrugations.

15. The tube member of claim 13, wherein said form attachment means comprises a circumferential flange integral with said body, said flange extending radially outwardly from said body at said one end.

16. The tube member of claim 13, wherein said body comprises an integral mass of thermoplastic resin.

17. The tube member of claim 15, wherein said flange includes a plurality of tear-away tabs for securing said tube member to the panel casting form, said tear-away tabs being capable of breaking off from said flange when the panel casting form is removed after the pre-cast concrete panel has set, leaving said body of said tube member embedded in the concrete panel with said flange of said one closed end flush with the side of the concrete panel.

18. A structure comprising a lower pre-cast concrete member, an upper pre-cast concrete member resting on top of the lower concrete member, and a connection device joining the members together, said connection device including an integral elongate, imperforate, and hollow tubular plastic body of a smoothly curved generally non-cylindrical cross-section embedded in the top of the lower concrete member with said body having a top open end facing the upper member, a bottom end facing away from the upper member, an outer wall including concrete-engaging circumferential corrugations propagating along the length of said body, an inner wall including grout-engaging circumferential corrugations propagating along the length of said body; concrete in the lower member extending into said concrete-engaging corrugations; grout filling the interior of said body and extending into said grout-engaging corrugations; a rod embedded in the upper member, said rod extending downwardly through said top open end of said body and into the grout in the interior of said body to form a connection therewith; and an opened transparent seal at said top end of said body surrounding said rod.

19. The structure of claim 18, wherein said bottom end of said body is closed, the outside of said bottom closed end being smoothly rounded and integrated with said outer wall corrugations and the inside of said other bottom closed end being smoothly rounded and integrated with said inner wall corrugations.

20. The structure of claim 18, wherein said body further includes an integral circumferential flange extending radially outwardly from said body at said top open end.

* * * * *